US008807338B2

(12) United States Patent
Moring et al.

(10) Patent No.: US 8,807,338 B2
(45) Date of Patent: Aug. 19, 2014

(54) MAILING PACKAGE FOR A LIGHT-WEIGHT PRODUCT

(75) Inventors: Dustin Moring, San Francisco, CA (US); Eric Manago, San Francisco, CA (US)

(73) Assignee: Square, Inc., San Francisco, CA (US)

( * ) Notice: Subject to any disclaimer, the term of this patent is extended or adjusted under 35 U.S.C. 154(b) by 0 days.

(21) Appl. No.: 13/454,855

(22) Filed: Apr. 24, 2012

(65) Prior Publication Data

US 2013/0277252 A1 Oct. 24, 2013

(51) Int. Cl.
*B65D 85/00* (2006.01)

(52) U.S. Cl.
USPC ..... 206/459.5; 206/701; 206/722

(58) Field of Classification Search
CPC ..... B65D 2203/00
USPC ..... 206/523, 592, 486, 488, 387.13, 308.1, 206/459.5, 701, 722, 474
See application file for complete search history.

(56) References Cited

U.S. PATENT DOCUMENTS

| | | | | |
|---|---|---|---|---|
| 4,754,880 | A * | 7/1988 | Tehrani | 206/723 |
| 4,986,419 | A * | 1/1991 | Collett et al. | 206/387.1 |
| 5,213,214 | A * | 5/1993 | Stringham | 206/564 |
| 5,249,670 | A * | 10/1993 | Simon | 206/773 |
| 2003/0230501 | A1* | 12/2003 | Smolev | 206/232 |
| 2008/0314784 | A1* | 12/2008 | Schroeder | 206/523 |
| 2012/0193903 | A1* | 8/2012 | Boyer | 283/67 |

* cited by examiner

*Primary Examiner* — David Fidei
(74) *Attorney, Agent, or Firm* — Fish & Richardson P.C.

(57) ABSTRACT

A package for mailing of a light-weight product includes a compressible body and a sheet that is less compressible than the body. A front face of the body has a cutout shaped to receive the product. The sheet has a planar first panel and a planar second panel. An inside face of the first panel is secured to a back face of the compressible body. The second panel is foldably connected to a first edge of the first panel and movable between a folded configuration in which the second panel covers the front face of the compressible body and an unfolded configuration in which the front face of the compressible body is uncovered and an inside face of the second panel is exposed. The sheet does not cover the top face and the bottom face of the compressible body.

14 Claims, 4 Drawing Sheets

MAILING PACKAGE FOR A LIGHT-WEIGHT PRODUCT

TECHNICAL FIELD

This disclosure relates to packaging for mailing of a small device, e.g., a small electronic device.

BACKGROUND

A conventional technique for shipping of a light-weight breakable product is to cover the product in a protective wrapping, e.g., bubble wrap, and insert the wrapped product into an envelope or box. The envelope or box can then be mailed, e.g., as a first class parcel.

SUMMARY

Although bubble wrap can protect a breakable product, the resulting package is relatively rigid. As such, the package typically needs to be mailed using parcel post. By making the package of compressible foam surrounded by paper cardstock, the packaging can be made more flexible so as to pass more easily through automated mailing equipment, while still protecting the product. In addition, the packaging can be mailed as a first class flat, which can have a postage rate significantly lower than a first class parcel.

In one aspect, a package for mailing of a light-weight product includes a compressible body and a sheet that is less compressible than the body. The compressible body has a front face and a back face on a side of the body opposite the front face. The compressible body has a top face and a bottom face on a side of the body opposite the top face. The front face has a cutout shaped to receive the product. The sheet has a planar first panel and a planar second panel. An inside face of the first panel is secured to the back face of the compressible body. The second panel is foldably connected to a first edge of the first panel and movable between a folded configuration in which the second panel covers the front face of the compressible body and an unfolded configuration in which the front face of the compressible body is uncovered and an inside face of the second panel is exposed. The sheet does not cover the top face and the bottom face of the compressible body.

In an uncompressed state the compressible body has a length, a height and a depth, the length may be greater than the height, the height may be greater than the depth. The length may be about 5 to 6 inches, e.g., 5.5 inches, the height may be about 2 to 4 inches, e.g., 3 inches, and the depth may be about 0.35 to 0.55 inches, e.g., 0.5 inches. The compressible body may be foam, e.g., an ether-like-ester (E.L.E.) foam with a density of 1.6 to 1.85 lb/ft$^3$. The sheet may be cardstock. The sheet may have a planar third panel, and the third panel may be foldably connected to a second edge of the first panel, the second edge on an edge of the first panel opposite the first edge. The third panel may be movable between a folded configuration in which the third panel covers the front face of the compressible body and an unfolded configuration in which an inside face of the third panel is exposed. In the folded configuration the second panel may abuts the front face of the compressible body and the third panel may covers the second panel. The product may be a credit card reader, and an outside face of the second panel may have an image of a portable electronic device into which a jack of the credit card reader is to be inserted. The inside face of the second panel may have indicia of credit card networks. An inside face of the third panel may have instructions for use of the credit card reader. The sheet may include a first strip between the first panel and the second panel, and a second strip between the first panel and the third panel. The first strip and the second strip may have a length about equal to a depth of the compressible body. The sheet may include a tab projecting from the second panel. The sheet may have a slot to receive the tab, the slot positioned at an edge between the third panel and the second strip. The cutout may be an aperture extending through the compressible body to expose the first panel. The cutout may be no more than about 1.5 inches across. The compressible body may have a depth no greater than 0.5 inches. The cutout may be positioned in about a center of the front face of the compressible body. The cutout may be positioned about 2 inches from a side face of the compressible body. In the folded configuration a thickness of the package may not vary more than 0.25 inches across the package. In the folded configuration a distance between an outer face of the first panel and an outer face of the second panel may varies by no more than 0.25 inches across the package.

Implementations may optionally include one or more of the following advantages. The packaging may be sufficiently flexible to pass through automated mailing equipment, while still protecting the product from damage. The packaging may be mailed as a first class flat, which may result in significant cost savings if a large number of units of product are shipped. The inside covers of the packaging may provide space for instructions for use of the device, branding or advertising. The packaging may present an esthetically pleasing unboxing experience.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
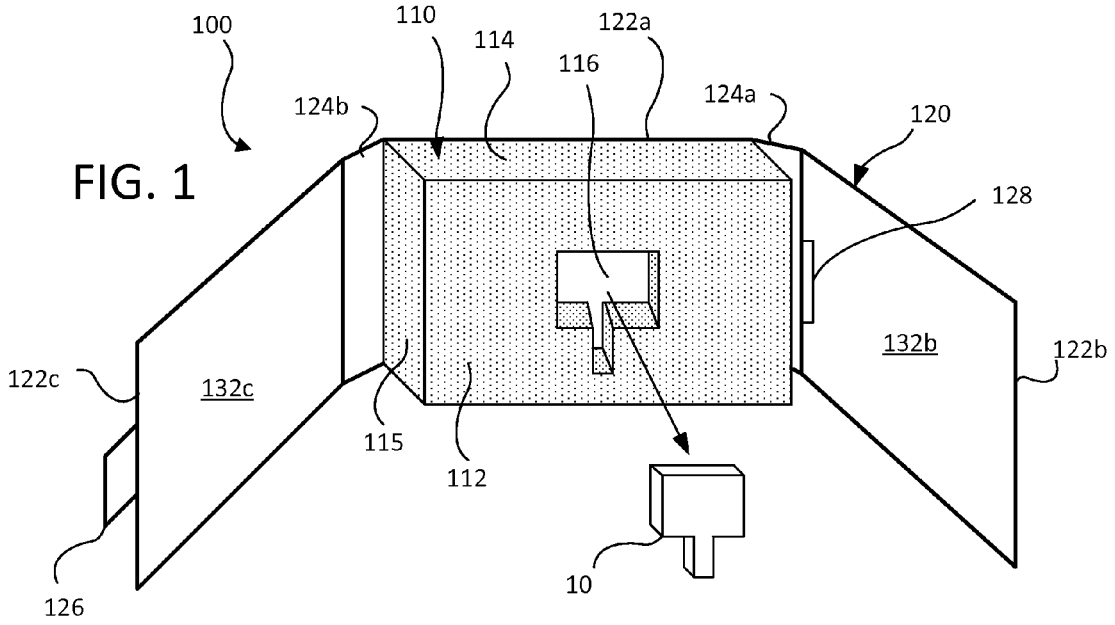
FIG. 1 is a perspective illustration of an implementation of packaging in an unfolded configuration.

FIG. 1 is a perspective illustration of an implementation of a package 100 for mailing of a product 10. The product 10 can be relatively light-weight, e.g., the total weight of the product 10 plus the package 100 can be thirteen ounces or less. The product 10 can be an electronic device. For example, the product 10 can be a credit-card reader that can be inserted into a port of a mobile electronic device, e.g., a smartphone, tablet computer, or the like. The port can be the audio port of the mobile electronic device.

The package 100 includes two main components: a compressible body 110 with a front face 112 and a back face on a side of the body 110 opposite the front face 112, and a sheet 120 that is foldable to cover the front face 112 and back face of the compressible body 110.

Figure 1A:
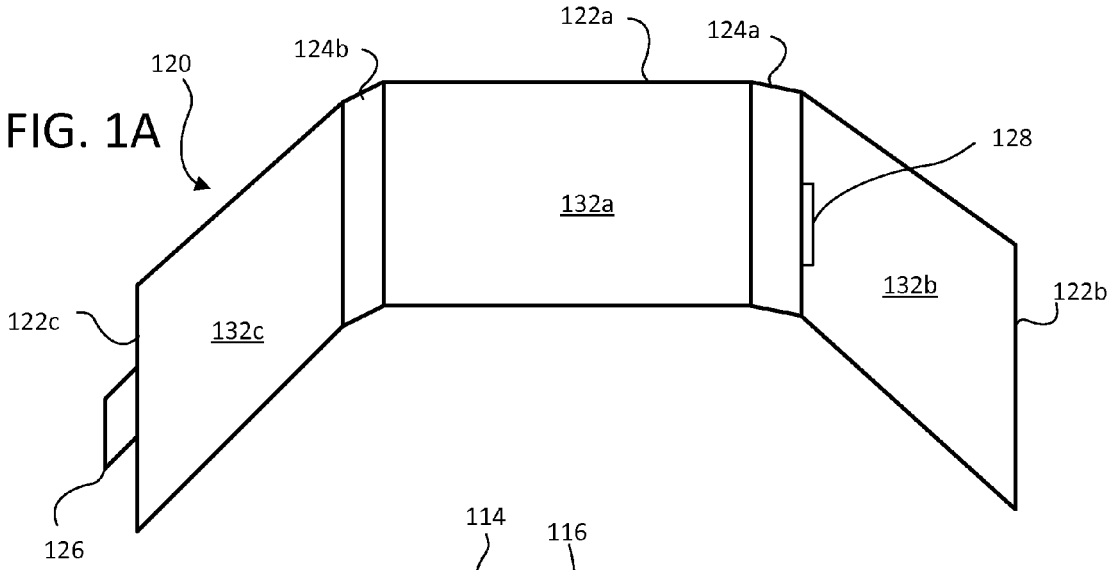
FIG. 1A is a perspective illustration of the sheet from the packaging in an unfolded configuration.
Figure 1B:
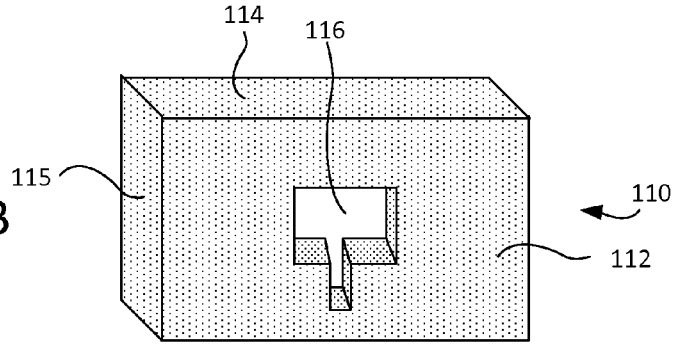
FIG. 1B is a perspective illustration of the compressible body from the packaging.
Figure 2A:
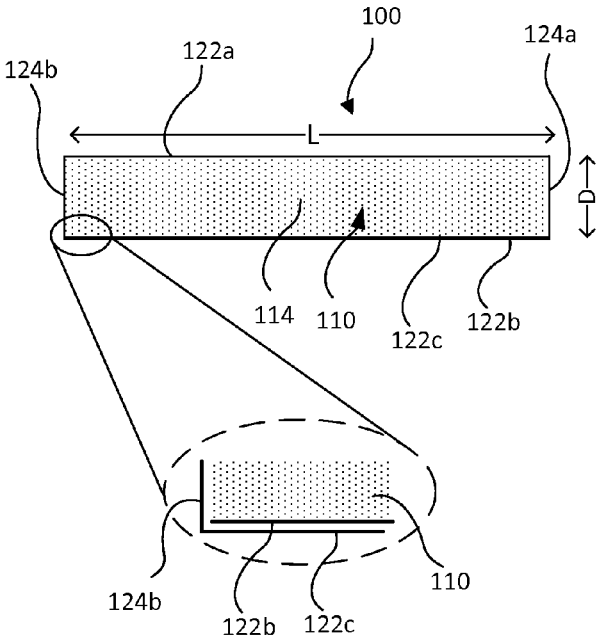
FIG. 2A is a top view illustration of the packaging in a folded configuration.
Figure 2B:
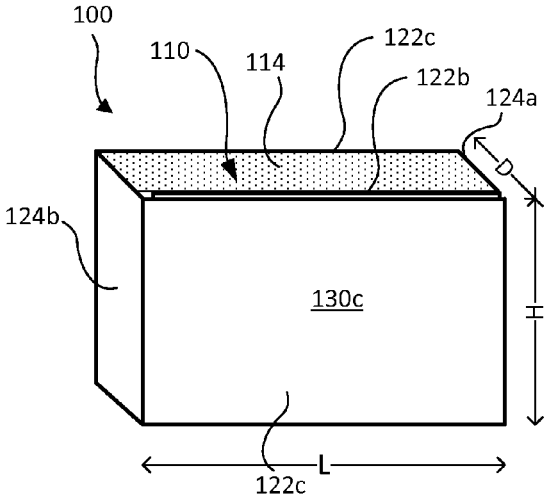
FIG. 2B is a perspective view illustration of the packaging in a folded configuration.

Referring to FIG. 1B, the compressible body 110 can be a rectangular parallelepiped, and can have a depth D of about 0.35 to 0.55 inches, e.g., 0.5 inches, a height H of about 2 to 4 inches, e.g., 3 inches, and a length L of about 5 to 6 inches, e.g., 5.5 inches (see FIGS. 2A and 2B). Thus, the compressible body can have a main front face 112, a back face on a side of the body 110 opposite the front face 112, elongated top face 114 and a bottom face, and two side faces 115 (only one side face is visible in FIGS. 1 and 1B).

The compressible body 110 can be a plastic foam material, e.g., an open-cell polyurethane foam. For example, the foam can be an ether-like-ester (E.L.E.) foam with a density from 1.6 to 1.85 lb/ft$^3$. However, other materials with similar compressibility and flexibility could be used. The compressible body 110 is generally elastic, i.e., it will spring back to its original shape if subjected to the stresses typical in shipping, e.g., when passing through automated mailing equipment.

Returning to FIG. 1, a cutout 116 is formed near the center of the front face 112 of the compressible body 110 in substantially the same shape as the product 10. The cutout 116 can extend only partially into the compressible body 110, i.e., be a recess, or the cutout 116 can extend entirely through the compressible body 110, i.e., be an aperture, to expose the sheet 120 underneath. The cutout 116 has a length (along the same axis as length L) not more than 2 inches, e.g., not more than 1.5 inches. For example, the cutout can have a length of about 1 inch. In addition, the distance from an edge of the cutout to the side face 115 of the compressible body 110 should be at least one inch. For example, this distance can be about 2 inches. For shipping, the product 10 fits snugly into the cutout 116 and can be loosely held in place by friction.

The sheet 120 is less compressible than the body 110. The sheet 120 can also be somewhat less flexible than the body 110. The sheet 120 can be paper. For example, the sheet 120 can be cardstock, e.g., 14 point cardstock paper.

Referring to FIGS. 1 and 1A, in some implementations, the sheet 120 includes a center panel 122*a*, a right panel 122*b* and a left panel 122*c*. Each panel can be rectangular, and can have the same height H as the compressible body 110*a*. In addition, each panel can have the same length as, or be slightly longer (e.g., by no more than 1 inch, e.g., by no more than 0.25 inches) than, the length L of the compressible body 110*a*. The left panel 122*c* has an inner face 132*c* and the right panel 122*b* has an inner face 132*b*, each inner face provided on the same side of the sheet 120. Similarly, the right panel 122*b* has an outer face 130*b* (see FIG. 3) and the left panel 122*c* has an outer face 130*c* (see FIG. 2B), each outer face provided by the opposite side of the sheet 120. The sheet 120 can be a single unitary sheet of uniform composition, e.g., without seams.

The left edge of the right panel 122*b* can be connected to the right edge of the center panel 122*a* by a strip 124*a*, and the right edge of the left panel 122*b* can be connected to the left edge of the center panel 122*a* by a strip 124*b*. The strips 124*a*, 124*b* are also rectangular, and can have the same height H as the compressible body 110*a*. In addition, each strip 124*a*, 124*b* can have the same length as, or be slightly longer (e.g., by up to 0.25 inches) than, the depth D of the compressible body 110. Each connecting edge between a panel and a strip can be creased so that the left and right panels 122*b* and 122*c* naturally tend to fold inwardly across the front face 112 of the compressible body 110.

A tab 126 can extend from the outer edge of the right or left panel 122*c* or 122*b*. A slot 128 can be formed at the edge between the other panel and the adjacent strip, e.g., between the right panel 122*b* and the strip 124*a* if the tab extends from the left panel 122*c*. The width of the slot 128 can be the same as the width of the tab 126.

The back face of the compressible body 110 is secured to the inner face 132*a* of the center panel 122*a* of the sheet 120, e.g., by an adhesive.

Referring to FIGS. 2A and 2B, for shipping, the left and right panels 122*c* and 122*b* are folded inwardly to cover the front face 112 of the compressible body 110. The tab 126, if present, can be inserted into the slot 128 (see FIG. 1) to hold the panels 122*b*, 122*c* in place. In some implementations, as shown in the top view of FIG. 2A, the right panel 122*b* can abut the front face 112 of the compressible body 110, and the left panel 122*c* can extend over the right panel 122*b*. Thus, the right panel 122*b* is sandwiched between the body 110 and the left panel 122*c*. Of course, for some implementations this could be reversed, with the left panel 122*c* abutting the compressible body 110, and the right panel 122*b* extending over the right left 122*c*.

The strips 124*a* and 124*b* are positioned adjacent the sides faces 115 of the compressible body 110. Due to slight bowing of the strips 124*a*, 124*b* they need not directly contact the compressible body 110.

With the panels 122*c* and 122*b* folded inwardly to cover the compressible body, the panels lay flat and the packaging 100 has a substantially uniform thickness. In particular, the depth of the packaging 100 does not vary by more than 0.25 inches across the package 100. This is another requirement to qualify for the postal flat mailing rate. In addition, the total thickness of the package (i.e., the depth D of the compressible body 110 and the thickness of the panels 122*a*, 122*b* and 122*c*) is less than 0.75 inches, e.g., slightly more than 0.5 inches.

As shown in FIGS. 2A and 2B, the panel 122*a* and 124*b* cover the rear face and front face 112, respectively, of the compressible body 110. Similarly, the strips 124*a* and 124*b* cover the right and left side faces 115, respectively, of the compressible body 110. However, the thin top face 114 and bottom face (not labeled) of the compressible body 110 are not covered by the sheet, and are instead left exposed. Intruding a covering sheet on the top and bottom faces of the compressible body would increase the rigidity of the packaging 100. Omitting the covering sheet 120 from the top and bottom faces improves the capacity of the packaging 100 to bend around an axis parallel to the height axis. This can help ensure that the packaging is sufficiently flexible to pass through automated mailing equipment. On the other hand, having the covering sheet 120 surround the front, rear and side faces provides increased rigidity against bending about other axes, thus helping protect the product from damage.

Figure 3:
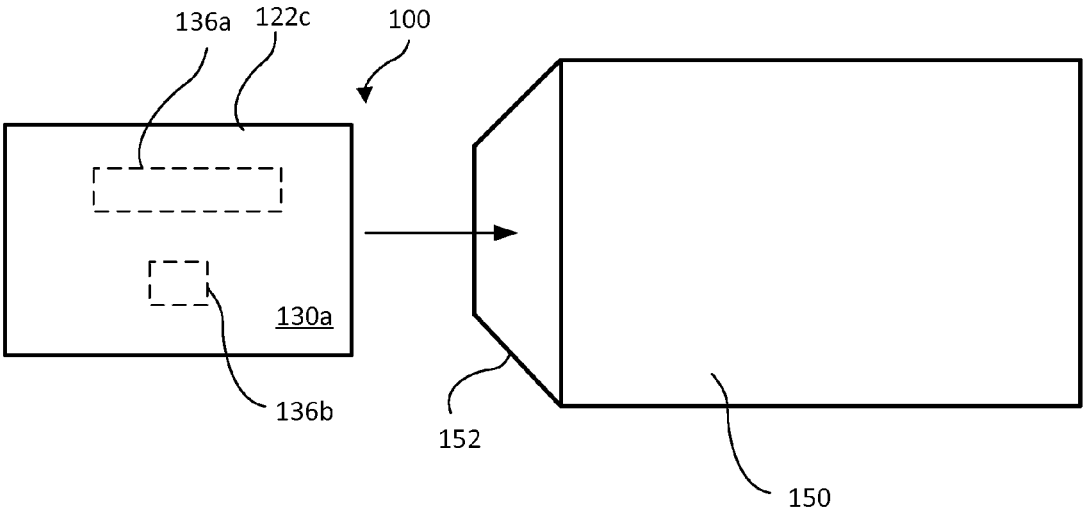
FIG. 3 is a front view illustration of the packaging being inserted into an envelope.

As shown in FIG. 3, in the folded configuration, the packaging 100 can be inserted into an envelope 150, e.g., an envelope formed of 100 lb. paper. The envelope can have a height of about 5¼ inches, and a length of about 8 inches.

Figure 4:
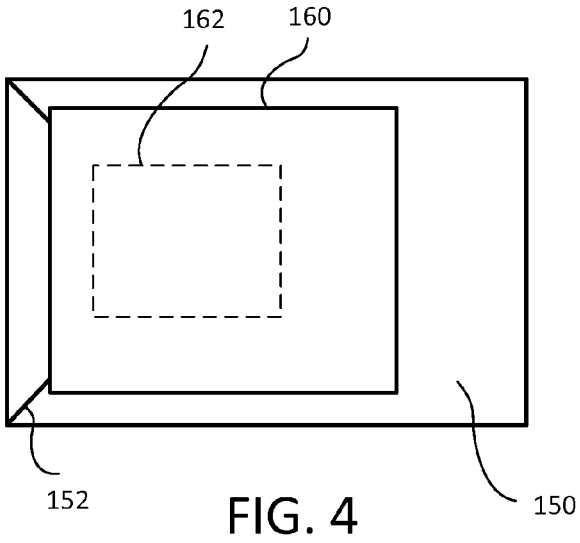
FIG. 4 is a front view illustration of the envelope.

As shown in FIG. 4, the flap 152 of the envelope 150 is closed, and a large sticker 160, e.g., a 4" by 4" mailing label, can be placed over the flap to secure the flap of the envelope to the body. Thus, the product cannot be removed from the envelope without damaging the envelope or the mailing label. Damage to the envelope or mailing label can therefore provide evidence of tampering with the product 10. The mailing label 160 includes the address information 162 for shipping of the envelope.

Once the package 100 is in the sealed envelope 150, the entire assembly should not have any bumps, protrusions or other irregularities, and the main thickness of the envelope 150 does not vary by more than 0.25 inches. Thus, the envelope should qualify for the postal flat mailing rate.

Figure 2C:
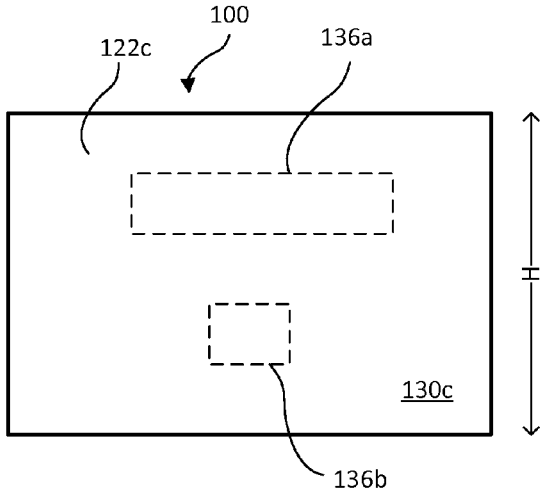
FIG. 2C is a front view illustration of the packaging in a folded configuration.

Upon receipt by a customer, the envelope 150 can be opened and the package 100 (still in the folded configuration) can be removed. Returning to FIGS. 2B-2C, in the folded configuration, the outer face 130*c* of the left panel 122*c* becomes the exposed front face of the packaging 100. The outer face 130*c* can include indicia of the manufacturer or supplier of the product 10. For example, the outer face 130*c* can include the name 136*a* of the manufacturer or supplier, and a company logo 136*b* of the manufacturer or supplier.

Figure 5:
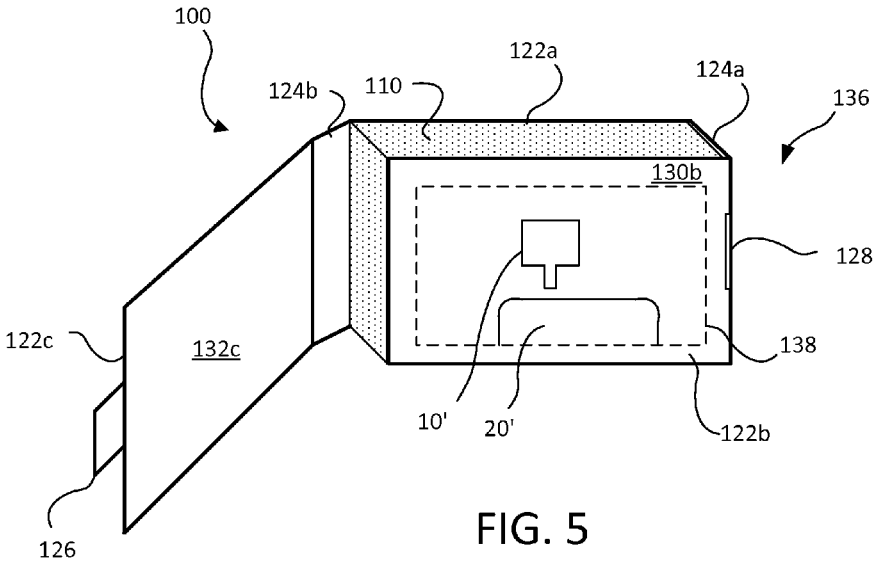
FIG. 5 is a perspective illustration of the packaging in an unfolded configuration.

Referring to FIG. 5, to unbox the product, the tab 126 is removed from the slot 128, and the left panel 122*c* is folded outwardly. This exposes the outer face 130*b* of the right panel 122*b*, which still covers the compressible body 110. The outer face 130*c* can include imagery 138, e.g., printed on the sheet 120 or applied with a sticker. The imagery 136 can illustrate the product 10 and the method of using the product 10. For example, if the product 10 is a credit card reader, the imagery can include a picture 10' of the credit card reader and a picture 20' of a smartphone, and can show the position for the credit card reader to be inserted into the smartphone, e.g., the alignment of the connector for the credit card reader to the audio input of the smartphone.

The outward folding of the left panel 122*c* also exposes the inner face 132*c* of the left panel 122*c*. The inner face 132 of the left panel 122*c* can include indicia 140 with instructions for use of the product. Again, the instructions can be printed on the sheet 120 or applied with a sticker.

Figure 6:
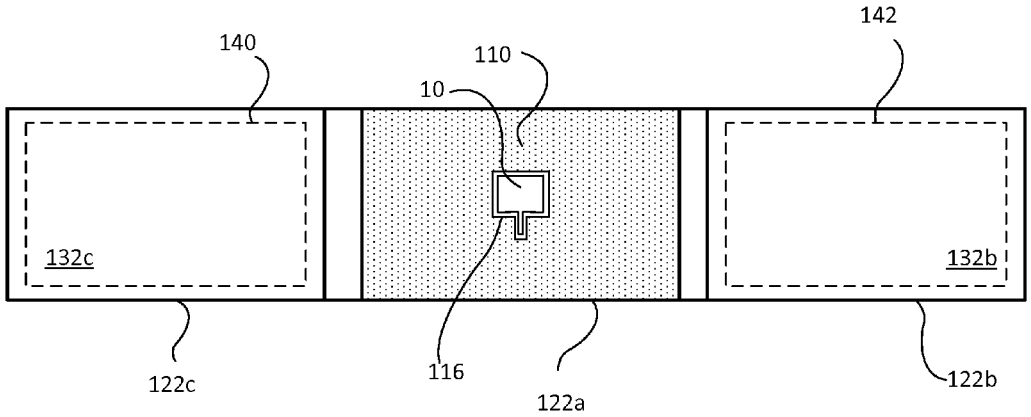
FIG. 6 is a side illustration of the packaging in an unfolded and flat configuration.

Referring to FIG. 6, the right panel 122*b* is folded outwardly, exposing the front surface 112 of the compressible body 110 and the cutout 116 holding the product 10. The product 10 can now be removed manually from the cutout 116.

The outward folding of the right panel 122*b* also exposes the inner face 132*b* of the right panel 122*b*. The inner face 132 of the left panel 122*c* can include indicia 142 with branding, trademark or similar information. For example, if the product is a credit card reader, the indicia 142 can include the logos of the various credit cards networks, e.g., VISA, MASTERCARD, AMEX, and the like, through which the card reader can accept payment. Again, the indicia 142 can be printed on the sheet 120 or applied with a sticker.

A number of implementations have been described. Nevertheless, it will be understood that various modifications may be made without departing from the spirit and scope of the subject matter described. For example, the sheet 120 could only include two panels, e.g., the center panel 122*a* and either the right or left panel 122*b* or 122*c*. As another example, the right and left panel 122*b* and 122*c* could extend across less than all of the length of the front face 112 of the compressible body 110, e.g., the right and left panel 122*a* and 122*c* could each extend about half-way across the compressible body 110. In this case, the slot 128 could be located near the outer edge of the panel rather than adjacent the strip 124*a*. Accordingly, other implementations are within the scope of the following claims.

What is claimed is:

1. A package for mailing of a card reader, comprising:

a compressible body having a front face and a back face on a side of the body opposite the front face, the compressible body having a top face and a bottom face on a side of the body opposite the top face, the front face having a cutout shaped to receive the card reader; and a sheet that is less compressible than the body, the sheet having a planar first panel, a planar second panel, and a planar third panel, an inside face of the first panel secured to the back face of the compressible body, the second panel foldably connected to a first edge of the first panel and movable between a folded configuration in which the second panel covers the front face of the compressible body and an unfolded configuration in which the front face of the compressible body is uncovered and an inside face of the second panel is exposed, the third panel foldably connected to a second edge of the first panel, the second edge on an edge of the first panel opposite the first edge, the third panel movable between a folded configuration in which the third panel covers the front face of the compressible body and an unfolded configuration in which an inside face of the third panel is exposed, wherein the folded configuration of the second panel abuts the front face of the compressible body and the third panel covers the second panel, and wherein the sheet does not cover the top face and the bottom face of the compressible body, wherein the sheet comprises a first strip between the first panel and the second panel and a second strip between the first panel and the third panel, the first strip and the second strip having a length about equal to a depth of the compressible body, wherein the sheet comprises a tab projecting from the second panel and a slot to receive the tab, the slot positioned at an edge between the third panel and the second strip, wherein an outside face of the second panel comprises an image of the card reader, the card reader comprising a connector, wherein the image includes a portable electronic device into which the connector of the card reader is to be inserted, wherein the image on the outside face of the second panel shows an alignment of the connector of the card reader with an audio input jack of the portable electronic device for inserting the connector of the card reader into the portable electronic device, and wherein the image of the card reader has a same orientation as the cutout shaped to receive the card reader, and wherein upon transitioning the second panel to the unfolded configuration, a card reader placed in the cutout is visible alongside an inside face of the third panel, the inside face of the third panel comprising instructions for inserting the connector of the card reader into the audio input jack of the portable electronic device and transferring card information between the card reader and the portable electronic device.

2. The package of claim 1, wherein the compressible body in an uncompressed state has a length, a height and a depth, the length greater than the height, the height greater than the depth.

3. The package of claim 2, wherein the length is about 5 to 6 inches, the height is about 2 to 4 inches, and the depth is about 0.35 to 0.55 inches.

4. The package of claim 3, wherein the length is about 5.5 inches, the height is about 3 inches, and the depth is about 0.5 inches.

5. The package of claim 1, wherein the compressible body comprises a foam.

6. The package of claim 5, wherein the foam comprises an ether-like-ester (E.L.E.) foam with a density of 1.6 to 1.85 $lb/ft^3$.

7. The package of claim 1, wherein the sheet comprises cardstock.

8. The package of claim 1, wherein the inside face of the second panel comprises indicia of credit card networks through which the card reader can accept payment.

9. The package of claim 1, wherein the cutout is no more than about 1.5 inches across.

10. The package of claim 1, wherein the compressible body has a depth no greater than 0.5 inches.

11. The package of claim 1, wherein the cutout is positioned in about a center of the front face of the compressible body.

12. The package of claim 1, wherein the cutout is positioned about 2 inches from a side face of the compressible body.

13. The package of claim 1, wherein in the folded configuration a thickness of the package does not vary more than 0.25 inches across the package.

14. The package of claim 1, wherein in the folded configuration a distance between an outer face of the first panel and an outer face of the second panel varies by no more than 0.25 inches across the package.

* * * * *